United States Patent [19]

Henry

[11] 3,948,197

[45] Apr. 6, 1976

[54] SAILBOAT HULL CONFIGURATION

[76] Inventor: Arthur S. Henry, 5042 Doanoke Ave., Irvine, Calif. 94538

[22] Filed: July 14, 1975

[21] Appl. No.: 595,341

Related U.S. Application Data

[63] Continuation of Ser. No. 462,858, April 22, 1974, abandoned.

[52] U.S. Cl. ..... 114/39; 114/56; 114/140

[51] Int. Cl.[2] ..... B63H 9/00

[58] Field of Search..... 114/39, 56, 65 R, 140–143; 9/6

[56] References Cited

UNITED STATES PATENTS

| | | | |
|---|---|---|---|
| 3,238,911 | 3/1966 | Pazulski | 114/39 |
| 3,507,240 | 4/1970 | Butler | 114/39 |

*Primary Examiner*—Trygve M. Blix
*Assistant Examiner*—Sherman D. Basinger

[57] ABSTRACT

A sailboat hull adapted to receive a mast and sailboat rigging with an interior concave keel forming an interior walkway. The keel is sufficiently deep and open to allow one to walk in the keel to provide sufficient head room for a person of normal height. The keel sides have a relatively vertical relationship to the bottom of the boat, and also has a relatively flat bottom. The upper hull itself has a substantially flattened bottom and sides extending from the transom forwardly in substantially vertical relationship to provide a substantially "stiff" sailing performance to the boat. The sides and bottom are configured so that a substantially geometrically normal angular relationship between them is maintained along a substantial portion of the length of the hull.

5 Claims, 8 Drawing Figures

SAILBOAT HULL CONFIGURATION

This is a continuation of a previously filed patent application entitled Sailboat Hull Configuration, bearing Ser. No. 462,858 and a filing date of Apr. 22, 1974and now abandoned.

BACKGROUND OF THE INVENTION

1. Field of the Invention

The field of this invention lies within the boating art, Specifically, the field lies in the sailboat art with respect to the features of a sailboat having a hull design with a minimum keel.

2. The Prior Art

The prior art relating to sailboats has fundamentally evolved out of a weighted keel and a streamlined steep sloping side configuration. With the advent of fiberglass reinforced plastic hulls, the configuration of the sides of the keel have been somewhat less exaggerated from the vertical in order to provide roomier interiors. Such sailboats have been provided with large interior spaces in order to accommodate the occupants. However, even in these particular instances, the sides are still relatively at a substantial angle from the vertical plane.

Lately, it has been popular to maintain a sailboat on a trailer. In other words, it has been popular to place a sailboat on a trailer and take it to the destination where it is to be sailed or stored, rather than maintain it in the water constantly.

In the particular instances where sailboat's for trailers have been developed, it has been customary to use a centerboard rather than a keel. This is due to the fact that the depth of the keel is so deep in relation to the other portions of the boat, that they are very hard to launch without a crane. For instance, sailboats for trailers can be launched by a crane or placed in the water if the trailer can be sunk to a depth of four or five feet. As can be understood, such a situation is oftentimes impractical because of the requirement of backing a trailer into the water with a car, and the inability to obtain a sufficient launching ramp angle without placing the car deeply in the water.

As a consequence, it has been customary to utilize a center board rather than a keel for a sailboat to be placed on a trailer.

The instant invention overcomes the foregoing deficiencies of a sailboat for a trailer having a deep keel or a center board. It utilizes a keel having a novel configuration adapted in combination with a hull configuration to cause the boat to function in a relatively "stiff" or self-righting manner against the force of the wind in the sails.

In addition to the foregoing sailing feature, the instant invention utilizes a keel having a walk-through configuration. Thus, a boat having a relatively shallow hull can provide standing space for one to walk around interiorly of the boat. Up until this time, boats for trailers have not had the provision of sufficient height to allow one to walk through the hull and stand up.

In summation, the hull of this invention incorporates the feature of a relatively shallow hull and keel with full head room in the cabin of the boat. The boat not only provides for standing room interiorly thereof with the utilization of a relatively shallow hull, but also has a flow design to provide for a stiff sailing performance. Thus, the force of the wind against the sails is counterbalanced by a stiff countervailing force at the keel.

SUMMARY OF THE INVENTION

In summation, this invention comprises a sailboat having a relatively shallow hull and keel to facilitate placing or launching a boat on or from a trailer. The keel provides a walk-through and stand-up space for an occupant from substantially the depth of the keel.

The invention also incorporates a hull configuration having a keel with relatively vertical sides that are not substantially offset from a vertical plane passing through the center of the boat. The bottom of the keel is substantially flat with respect ot the sides of the keel. The entire hull has sides substantially parallel to a vertical plane passing through the center line of the hull and also has a relatively flattened bottom extending from the sides of the keel.

In essence, the hull configuration is optimized to allow for a substantially stiff righting force against the force of the wind in the sails, and is formed so that one can stand within the keel in an upright position.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
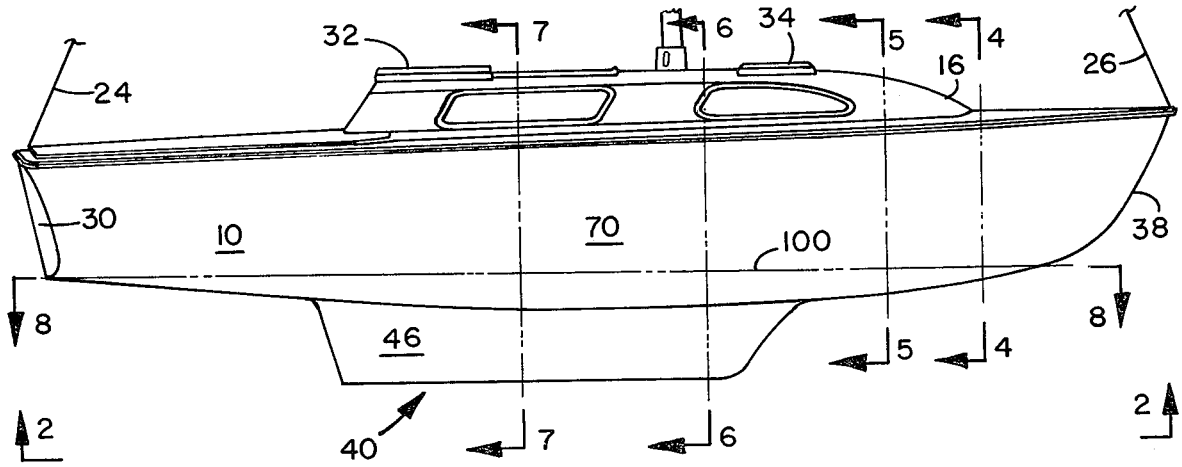
FIG. 1 shows a side elevation view of the boat hull.
Figure 2:
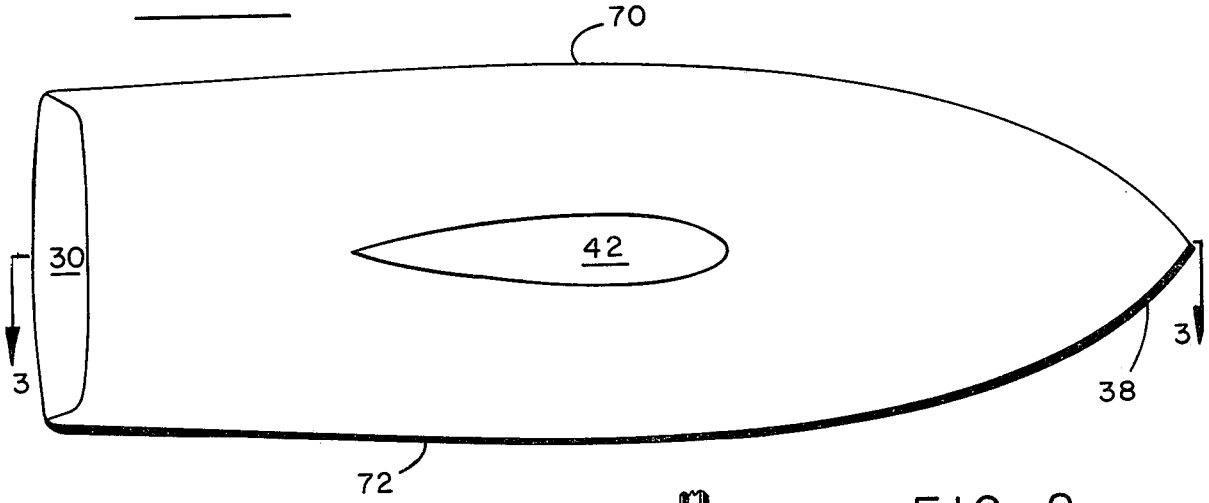
FIG. 2 shows the hull looking upwardly at the bottom along lines 2—2 of FIG. 1.
Figure 3:
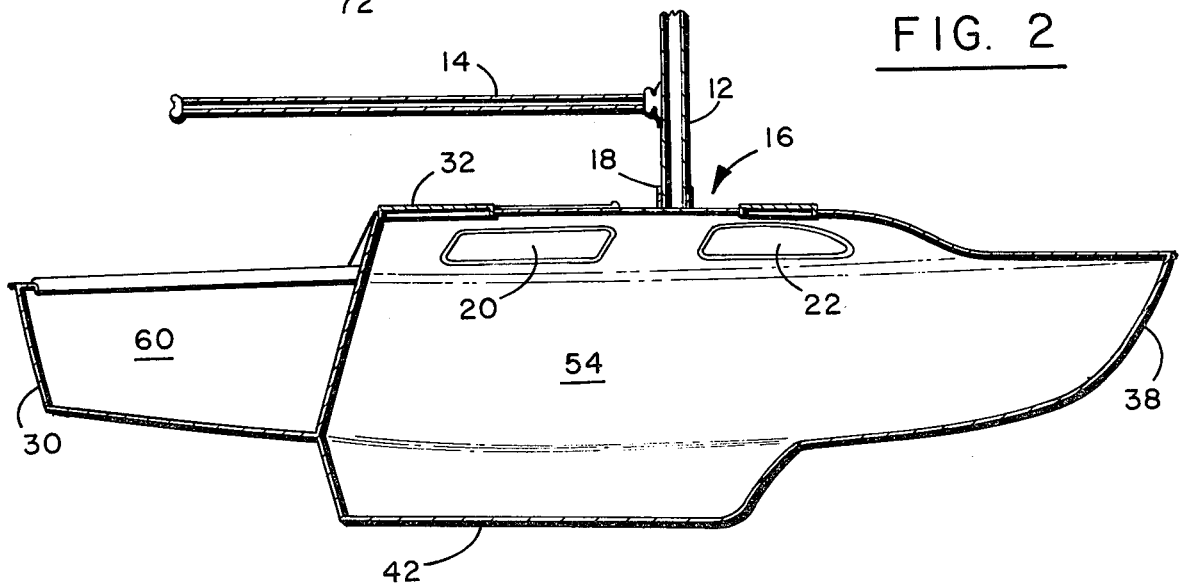
FIG. 3 shows a view of the boat hull in section along lines 3—3 of FIG. 2.
Figure 5:
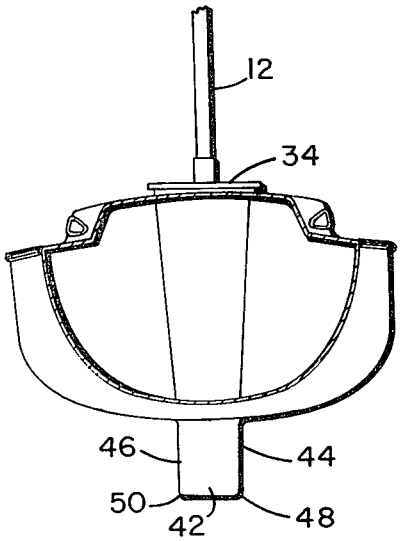
FIG. 5 shows a second station in cross section through the boat hull along lines 5—5 of FIG. 1.
Figure 4:
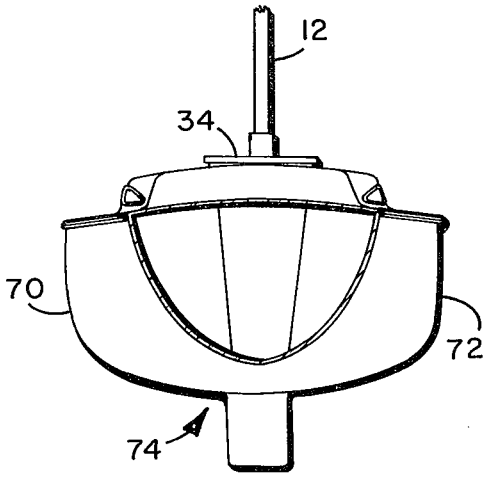
FIG. 4 shows a sectioned station through the hull of the boat as sectioned along lines 4—4 of FIG. 1.
Figure 7:
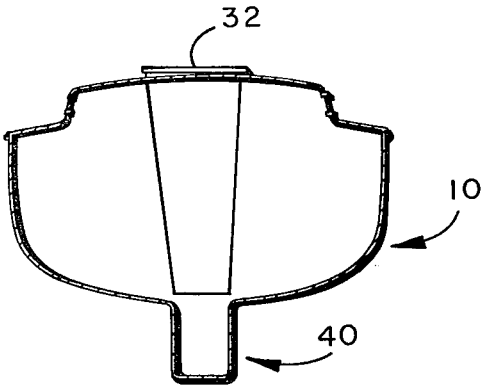
FIG. 7 shows a fourth station through the boat hull as sectioned along lines 7—7 of FIG. 1; and, FIG. 8 shows a sectional view of the bottom part of the hull and keel configuration looking downwardly along lines 8—8 of FIG. 1.
Figure 6:
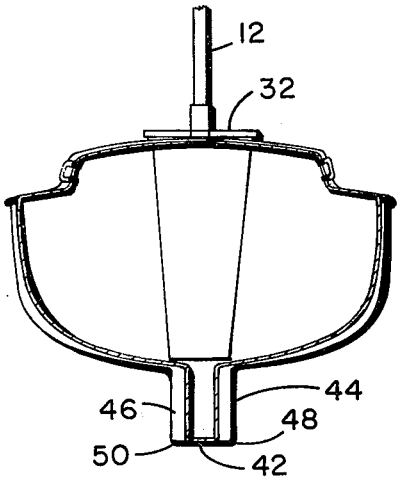
FIG. 6 shows a third station of the boat hull as sectioned along lines 6—6 of FIG. 1.

Looking more particularly at the figures, a general hull configuration 10 is shown having a mast 12 and a boom 14. The mast 12 and boom 14 are secured to a cabin 16 of the boat by means of a receptacle 18. The cabin 16 has windows on either side thereof which are bilaterally symetrical. For purposes of identification they are designated windows 20 and 22.

The sailboat is a standard sloop rig sailboat configuration having fore and aft stays 24 and 26.

The boat has a transom 30 that conforms to the remainder of the boat which shall be described. The transom is of a type which is more or less on the same conformation as most transoms, except for the cross sectional configuration which conforms to the remainder of the hull as will be described.

The cabin 16 has a hatch 32 for providing access to the interior of the cabin. The hatch 32 can be of any type providing a sliding hatch configuration. Additionally, a second hatch 34 is provided forward of the first hatch for ventilation and escape.

The hull configuration has a bow 38 which is fundamentally a blunted bow of a regular configuration. The remainder of the hull is substantially different from a sailboat hull.

Looking more specifically at the general hull, a keel 40 having a flattened bottom 42, is shown. The keel with the flattened bottom 42 can be provided with ballast, which has not been shown, along its bottom inside surface. The keel 42 has a substantially rectangularly oriented cross section wherein the bottom 42 meets the sides 44 and 46 in a manner whereby the angle where they meet, respectively angles 48 and 50, is a relatively normal angle. The sides of the keel are within the range of five degrees from the normal with respect ot the flat bottom of the keel along at least sixty percent of the keel's length. As used herein and hereinafter, normal as to angles and intersecting surfaces shall designate such angles and intersecting surfaces as being perpendicular to a tangent line or plane at the point of tangency or intersection. The angles 48 and 50 are provided with a quarter round in this particular instance, of no more than that required for structural integrity and a smooth conformation. The angles 48 and 50 where they meet the bottom 42, should be no greater than five degrees from a vertical relationship as it relates to the mid-line vertical section of the boat hull.

A unique feature of the boat is the fact that the interior 54 of the cabin provides a substantial amount of room within the interior of the keel 40 along its flat bottom 42. More than 50 percent of the depth of the keel is exposed to the interior of the cabin. Thus, one can stand up in most conformations of the hull and not be concerned about a lack of head room.

The cockpit 60 is sufficiently roomy and allows for ample room for the occupants as well as allowing one to step into the interior of the keel 40 without substantial difficulty. Most of the areas adjacent the keel on the sides of the boat interiorly of the cabin are provided with cabinetry, galley space, a stove and a refrigerator. Thus, it is only necessary for one to stand near the center line of the boat away from the cabinetry. The hull conformation with its step-down keel 40 allows for this. As a consequence, one can walk through the boat comfortably without any substantial degree of bending or turning to facilitate the accommodation of one's body to the overall height and depth of the hull and the interior portions thereof.

Looking more specifically at the sides of the boat, it can be seen that a relatively steep pair of sides 70 and 72 are formed with a substantially flattened bottom 74. The sides 70 and 72 formed with the bottom 74 allow for a very stiff reaction of the boat when a breeze is blowing against the sails, so that a countervailing force by the keel and the hull configuration provides significant righting action.

The hull configuration with its sides 70 and 72 is a substantially vertical or normal relationship with respect to the angle of the sides to the bottom along a majority of its depth. This condition should generally exist for approximately 75% along the length of the keel. It should not be less than approximately 60% nor more than 85% in order to provide a streamlined configuration, yet at the same time the parameters causing the hull to conform to the advantages inherent in its design.

The sides 70 and 72 of the boat should generally comprise a relatively right angular or normal relationship with the bottom within the ranges specified for at least 50% to 65% of the boat. In other words, the sides 70 and 72 should not start bending downwardly and inwardly toward the keel until they come forwardly at least the foregoing percentage.

In order to more fully define the relationship of the boat hull bottom with respect to the sides, certain stations, 4, 5, 6, and 7 representative of cross sections 4, 5, 6, and 7 have been shown. At these particular stations and between them, an approximate configuration of the tangency of the sides with respect ot the bottom where the two meet, should be maintained. The distance from the center of the keel to the outer limits of the bottom at its point of tangency to the bottom should be such that the sides are not greater than approximately two thirds as to their height with respect to the bottom. The sides 70 and 72 should not taper inwardly toward the keel at the foregoing stations, particularly at stations 6 and 7 at an angle exceeding five degrees from the vertical.

The bottom of the boat as it extends toward the sides should not exceed an angle of 15° as to the right angle drawn from the vertical or normal sections along the hull. In other words. In what would normally be a horizontal view, the angle of the inclination of the bottom of the boat should not exceed fifteen degrees with respect to the normal or point of tangency with the sides 70 and 72.

The keel 40 should be within the range of no greater than one half of the total length of the boat. Furthermore, the keel width at its widest point should be between 10% and 15% of the overall length, in order to provide a smooth, running hull with an appropriate keel.

Figure 8:
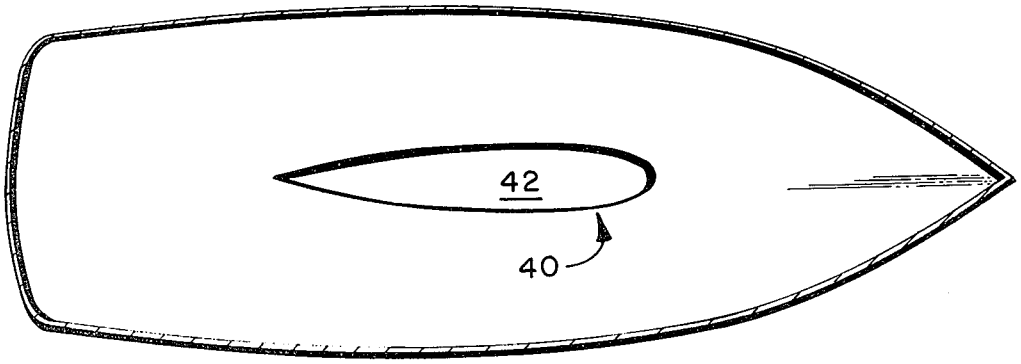

Looking more particularly at FIG. 8 and the section lines 8—8 of FIG. 1, a cross sectional line 100 is shown. The cross sectional line 100 generally extends from the bottom of the transom 30 to the bottom of the bow 38. The line 100 can be further defined as a horizontal line with respect to a vertical line through the central axis of the hull 10. The bottom of the hull should not have a greater angular relationship along any point of tangency than twelve percent from the line 100.

The foregoing general configuration of the boat within the ranges is to be construed as showing a preferred embodiment. However, the broad scope of the flattened hull for a substantial length of the boat and the walk-through keel is to be considered as a general embodiment to be read in the scope and spirit of the following claims.

I claim:

1. A sailboat hull adapted for receiving a mast and having a cockpit therein with a cabin enclosure wherein the improvement comprises:

a boat hull having a depending keel formed in said hull with an interior thereof having more than fifty percent of its depth exposed to the interior of said cabin along at least part of its length said keel forming a walkway substantially along its entire length. To allow one to stand within the interior opening of said keel to the depth at which the interior of the keel is exposed within the cabin.

2. The sailboat hull as claimed in claim 1 wherein said boat hull is comprised of:

reinforced plastic.

3. The sailboat hull as claimed in claim 1 wherein:

the bottom of said keel is substantially flat.

4. The sailboat hull as claimed in claim 3 wherein:

the sides of said keel are substantially within the range of five degrees from the normal with respect to the flat bottom of said keel along at least sixty percent of the length thereof.

5. The sailboat hull as claimed in claim 4 wherein:

the keel is no greater than one half of the length of the boat hull.

* * * * *